US006668948B2

(12) United States Patent
Buckman, Sr. et al.

(10) Patent No.: US 6,668,948 B2
(45) Date of Patent: Dec. 30, 2003

(54) NOZZLE FOR JET DRILLING AND ASSOCIATED METHOD

(75) Inventors: William G. Buckman, Sr., Bowling Green, KY (US); Thomas L. Dotson, Bowling Green, KY (US); Michael D. McDaniels, Glasgow, KY (US); Wendell S. Bell, Glasgow, KY (US)

(73) Assignee: Buckman Jet Drilling, Inc., Bowling Green, KY (US)

( * ) Notice: Subject to any disclaimer, the term of this patent is extended or adjusted under 35 U.S.C. 154(b) by 0 days.

(21) Appl. No.: 10/119,790

(22) Filed: Apr. 10, 2002

(65) Prior Publication Data

US 2003/0192718 A1 Oct. 16, 2003

(51) Int. Cl.[7] ..... E21B 7/18; E21B 43/114

(52) U.S. Cl. ..... 175/67; 175/61; 175/424; 175/393; 299/17; 239/494; 239/463; 239/497

(58) Field of Search ..... 175/67, 424, 61, 175/393, 340, 45; 239/463, 498, 494, 492, 490, 483, 497; 299/17

(56) References Cited

U.S. PATENT DOCUMENTS

| | | | | | |
|---|---|---|---|---|---|
| 4,047,380 | A | * | 9/1977 | Heffernan | 60/39.461 |
| 4,570,860 | A | * | 2/1986 | Aprea et al. | 239/478 |
| 4,664,314 | A | * | 5/1987 | O'Brien et al. | 239/469 |
| 4,715,538 | A | | 12/1987 | Lingnau | 239/248 |
| 4,787,465 | A | * | 11/1988 | Dickinson et al. | 175/67 |
| 4,790,394 | A | | 12/1988 | Dickinson, III et al. | 175/61 |
| 4,842,197 | A | * | 6/1989 | Simon et al. | 239/5 |
| 4,852,668 | A | | 8/1989 | Dickinson, III et al. | 175/67 |
| 4,969,602 | A | * | 11/1990 | Scholl | 239/298 |
| 5,067,657 | A | * | 11/1991 | Young et al. | 239/403 |
| 5,072,796 | A | | 12/1991 | Shen et al. | 175/340 |
| 5,170,946 | A | | 12/1992 | Rankin | 239/590 |
| 5,255,750 | A | * | 10/1993 | Wilkes et al. | 175/61 |
| 5,291,957 | A | | 3/1994 | Curlett | 175/67 |
| 5,353,599 | A | * | 10/1994 | Johnson et al. | 60/748 |
| 5,542,486 | A | * | 8/1996 | Curlett | 175/424 |
| 5,626,508 | A | | 5/1997 | Rankin et al. | 451/102 |
| 5,769,164 | A | | 6/1998 | Archer | 166/222 |
| 5,782,414 | A | | 7/1998 | Nathenson | 239/589 |
| 5,785,258 | A | | 7/1998 | Akin et al. | 239/590 |
| 5,853,056 | A | * | 12/1998 | Landers | 175/424 |
| 5,862,871 | A | | 1/1999 | Curlett | 175/340 |
| 5,897,062 | A | * | 4/1999 | Enomoto et al. | 239/590 |
| 6,065,683 | A | | 5/2000 | Akin et al. | 239/5 |
| 6,189,629 | B1 | | 2/2001 | McLeod et al. | 175/67 |
| 6,206,112 | B1 | | 3/2001 | Dickinson, III et al. | 175/67 |
| 6,263,984 | B1 | | 7/2001 | Buckman, Sr. | 175/67 |
| 6,551,095 | B2 | * | 4/2003 | Tackels et al. | 431/8 |

OTHER PUBLICATIONS

"Horizontal Radial Drilling with a Swirling Water Jet"; *Water Jet Technology in Petroleum Engineering*, Shen Zhonghou, Pet. Univ. Press, 1997, Chap. Six, pp. 115–149).

Aqua–Dyne brochures "Nozzles", 2001.

"Clonical Water Jet Drilling, " Dickinson, W., Wilkes, R.D., and Dickinson, R.W. Proceeding of the Fourth U.S. Water Jet Conference, Aug. 26–28, 1987 at the University of California, Berkeley. Water Jet Technology Association. www.wjta.org.

"The Ultrashort–Radius Radial System," Dickinson, W., Anderson, R.R., Dickinson, R.W. Society of Pertroleum Engineers paper 14804 (1989).

* cited by examiner

*Primary Examiner*—David Bagnell
*Assistant Examiner*—T Shane Bomar
(74) *Attorney, Agent, or Firm*—Baker Botts L.L.P.

(57) ABSTRACT

A jet nozzle is provided for drilling holes through the earth, such as drainholes around a well. The nozzle may include orifices for discharging fluid to drive the nozzle forward and includes a disk or other device having orifices to produce a swirling motion to fluid in the body of the nozzle. Swirling fluid is discharged from a front orifice and an extension is placed forward of the front orifice to confine the swirling fluid in a radial direction.

23 Claims, 3 Drawing Sheets

NOZZLE FOR JET DRILLING AND ASSOCIATED METHOD

BACKGROUND OF THE INVENTION

1. Field of the Invention

This invention pertains to drilling of holes through the earth. More particularly, a nozzle is provided for drilling of drainholes from wells and other small-diameter holes.

2. Description of Related Art

There are a variety of reasons to drill small-diameter holes through the earth. For example, fiber optics cable, utility lines, bolt holes in mines and drainholes from wells require such holes.

Drainholes drilled from wells into selected subsurface formations have been widely investigated. U.S. Pat. No. 6,263,984 B1 includes a discussion of jet drill bits and several prior art methods and types of apparatus for drainhole-drilling using fluid jets.

Jet bits for drilling that incorporate a swirling motion to the fluid before or after it is discharged against the rock to be cut are known. For example, U.S. Pat. No. 4,790,394 discloses "a whirling mass of pressurized cutting fluid ." The swirling fluid exits a nozzle as a free jet that increases in diameter as it moves away from the nozzle. A variety of mechanical configurations for producing the swirling motion are disclosed. U.S. Pat. No. 6,206,112 B1 discloses vortex generators as part of a drilling apparatus which includes drilling heads at the end of extensible drilling tubes. In one embodiment, the drilling head has a hemispherical nose with a plurality of nozzles that are directed at an angle such as to generate a vortex outside the nozzle as fluid exits.

The use of swirling jets along with mechanical cutters has also been investigated. A spinning jet stream is disclosed in U.S. Pat. No. 5,291,957. The spinning jet stream is developed from a tangentially driven vortex flow system. The stream is used along with an apertured mechanical cutting element that places the exiting spinning jet against a surface to be cut. U.S. Pat. No. 5,862,871 discloses, in one embodiment, a nozzle having a central bore through the housing with discharge of a portion of the fluid passing through the central bore as a swirling stream and part as an axial stream.

Researchers at the University of Petroleum in China have made extensive studies of water jet drilling, including horizontal radial drilling with a swirling water jet (*Water Jet Technology in Petroleum Engineering*, Shen Zhonghou, Pet. Univ. Press, 1997, Chap. Six, pp. 115–149). Nozzles having vanes to produce a swirling motion of the drilling fluid as it forms a jet were developed. Structural features of the vanes and corresponding axial and tangential velocity distributions in a swirling jet are described in the referenced book. The exit orifices of nozzles investigated were usually 4.0 mm or 6.40 mm in diameter and had a length in the range from 0.5- to 5.0- times the diameter of the orifice. The higher drilling rate observed with a swirling jet compared with a straight jet was explained by the facts that: (1) the cutting action of a swirling jet is influenced more by shear strength of a rock than by its compressive strength, and (2) the shear strength of a rock is lower than its compressive strength. The effect of stand-off distance, i.e., the distance from the jet exit to the rock surface, was investigated and it was found that the advantages of the swirling jet exist in the range of small stand-off distances. Typically, the diameter of the hole cut by the swirling jet was several times the diameter of the jet nozzle. Also, as the rock was cut the depth of the center of the hole was less than the depth around the perimeter of the hole. Drilling rates measured in sandstone at a pump pressure in the range from about 7,000–8,000 psi and at a pumping rate in the range of 100 GPM were in the range of about 14–22 ft/hr, with hole diameters in the range from about 2 to 4 inches (50 to 100 mm). All references cited above are hereby incorporated by reference herein.

What is needed is a jet nozzle that drills a hole through the earth, such as a drainhole, having a diameter large enough for its intended application and large enough to allow cuttings to pass outside the nozzle and the tube to which the nozzle is attached, but that drills the hole rapidly with minimum flow rate and horsepower requirements. The jet nozzle should be attachable to the distal end of a tube that supplies the drilling fluid. Preferably, the nozzle should exert a force in the direction to push the nozzle and tube through rock, but should also drill at a rapid rate without high sensitivity to stand-off distance.

BRIEF SUMMARY OF THE INVENTION

A nozzle is provided for drilling through the earth. The nozzle includes a device for imparting swirling motion to fluid passing through the nozzle before the fluid is discharged through a front orifice. Orifices in the body of the nozzle may be directed toward the inflow end of the nozzle so as to provide a force to drive the nozzle and an attached tube through the hole being drilled. An extension is placed ahead of the front orifice to limit the radius of the swirling fluid discharged from the orifice. Method for drilling through the earth using the nozzle is provided.

DESCRIPTION OF THE DRAWINGS

For a more complete understanding of the present invention and the advantages thereof, reference is now made to the following description, taken in conjunction with the accompanying drawings, in which like reference numbers indicate like features and wherein:

FIG. 3(*a*) shows an elevation view, FIG. 3(*b*) shows an end view, and FIG. 3(*c*) shows an isometric view.

FIG. 4(*a*) shows an elevation view, FIG. 4(*b*) shows an end view, and FIG. 4(*c*) shows an isometric view.

DETAILED DESCRIPTION OF THE INVENTION

Figure 1:
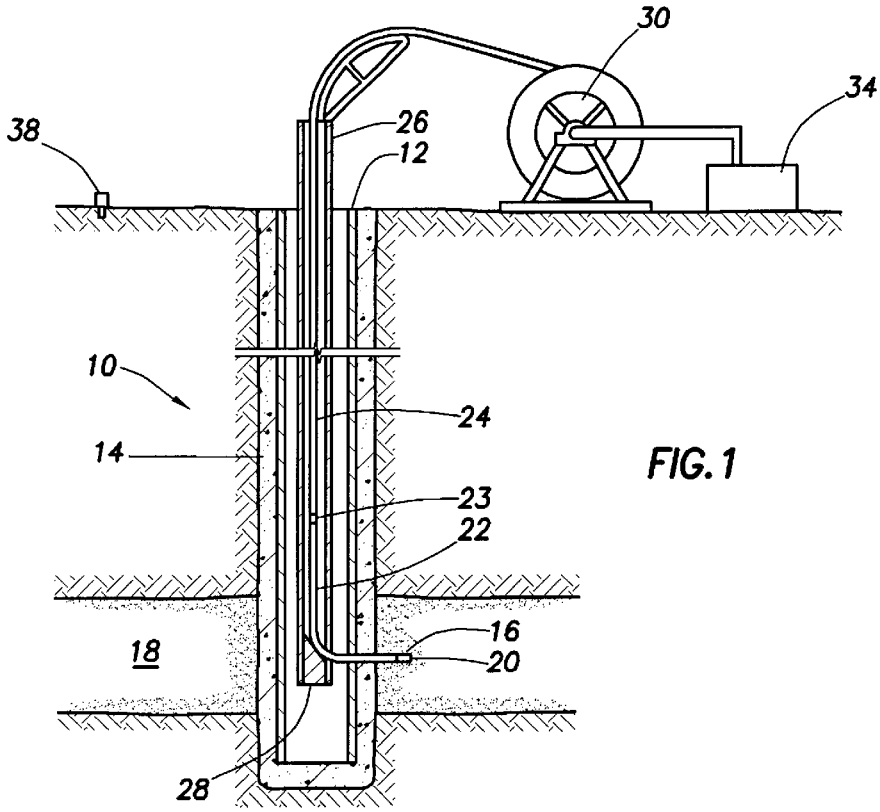
FIG. 1 illustrates a cased well and a drilling apparatus for drilling through a casing and drilling a drainhole in a reservoir.

Referring to FIG. 1, one embodiment of a drilling apparatus, such as disclosed in U.S. Pat. No. 6,263,984, hereby incorporated by reference, is illustrated. Nozzle jet drill 20 has been used to drill through casing 12 and cement 14 and is used to continue drilling lateral hole or drainhole 16 through reservoir 18. Nozzle jet drill 20 is attached to elastomeric tube 22, which in turn is connected to flexible steel tube (coiled tubing) 24 at connection 23. Upset tubing (rigid) 26 may be used to place bit diverter 28 in the well. The bit diverter is designed to turn a jet bit attached to an elastomeric tube through about a 90 degree turn, more or less. Diverter 28 may be a funnel tube guide which contains a wider top and narrows down to an outlet hole at the bottom, where a constriction (not shown) may be placed to enable a drill to kick-off. Alternatively, diverter 28 may be placed in casing 12 using well known wire line placement methods without the use of upset tubing 26 in the well. A recessed replaceable blasting plate (not shown) made of hard material such as tungsten carbide or the like, may be used to protect the funnel tube guide during the initial drilling through the wall of casing 12. Coiled tubing 24 extends to the top of well 10 and may coil onto reel 30.

Drilling fluid may be pumped down the well by pump 34. Drilling fluid may contain abrasive particles, preferably ranging from about mesh 20 to about mesh 140. A water-soluble polymer such as J362, available from Dowell/Schlumberger, may be used in the concentration range of about 10 pounds to about 40 pounds per 1,000 gallons of liquid to keep the abrasive particles suspended and to lower friction pressure loss during flow of drilling fluid through tubing 22 and 24. Concentration of abrasive particles may be selected depending on drilling conditions, but normally concentrations up to about one-half pound of abrasive per gallon may be used. Chemicals such as KCl and HCl may be added to drilling fluid to assure that the fluid is compatible with the reservoir rock. Preferably, the fluid pumped is filtered to minimize plugging of orifices in a bit and fluid may be heated to decrease friction loss during flow downhole. Flow rate of drilling fluid may vary widely, but may be, for example, about 10 gallons per minute A suitable high-pressure pump such as pump 34 is a Kerr Pump, such as KP-3300-XP, of triplex design with ceramic plungers. It will provide over 4,000 psi at rates from 4.8 GPM to 21.5 GPM. A 24-horsepower unit should suffice for most shallow-well applications; that is, for well depths less than 2500 feet. Other common high-pressure triplex pumps with ratings to and above 10,000 psi may be used. Elastomeric tube 22 may be a Gates Rubber Company 6M2T product, product number 4657-1554, which has a minimum burst pressure of 16,000 psi, an inner diameter of 0.375 inch, and outer diameter of 0.69 inch, and a minimum bend radius of 2.5 inches. Other such tubes may be used having higher pressure ratings and smaller minimum bend radius or smaller hydraulic hose capable of withstanding burst pressures up to 10,000 psi or more may be used. An intermittent pressure valve may be placed downstream of pump 34 to enable the introduction of pressure pulses into the drilling fluid that will be transmitted to drill 20. The pulsed pressure waves from the drill may be detected at the surface or in the bore hole by geophones 38 and used to monitor the position of drill 20, using known techniques. Direction-indicating instruments such as a gyroscope, magnetometer or accelerometer(s) or combinations of these instruments may be placed near bit 20 and information from such measurements may be transmitted to surface while drilling using known measurement-while-drilling (MWD) techniques, such that the operator is informed of the initial direction of the nozzle-jet into the formation and its subsequent direction. Normally, the operator will desire to maintain lateral hole 16 within reservoir 18 as drilling proceeds.

In one embodiment, bit diverter 28 is installed onto the bottom of the upset tubing. Tubing 26 is lowered to a selected depth and may be turned to the desired direction for penetrating casing 12. Direction of diverter 28 may be determined using gyroscopic or other known techniques, either attached to tubing 26 or run on wire line and retrieved. Nozzle jet drill 20 may be threadably attached to a length of elastomeric tube 22, typically 0.375 inch inner diameter or smaller hydraulic hose capable of withstanding burst pressures up to 10,000 psi. Alternatively, elastomeric tube may be 0.25-inch diameter KEVLAR tubing. The length of elastomeric tubing 22 determines the maximum distance the lateral drainhole 16 can be drilled from the well 10. Elastomeric tube 22 may be joined to steel coiled tubing 24 and may be wound onto reel 30. A flexible high-pressure wire-braided thermoplastic tube similar to types supplied by Spir Star may be used, which can be reeled out and in boreholes many times without the significant fatigue that occurs in steel coiled tubing. Drill 20 is attached to elastomeric tubing 22 and they are lowered into upset tubing 26 if it is present in the well. If it is not present, drill diverter 28 is set by wire line, using techniques well known in industry, and drill 20 is lowered down casing 12. When drill 20 enters the outlet of bit diverter 28, pump 34 is activated and drilling fluid, preferably containing abrasive particles, is pumped for several minutes at a pump pressure of up to about 4500 psi. Elastomeric tube 22 may be a little taut because jet drill 20 may have a momentum push against bit diverter 28. After casing 12 is perforated, drill 20 will enter reservoir 18 and continue drilling for a short distance using the abrasive liquid. After drilling about one foot, for example, into reservoir 18 a drilling fluid without abrasive particles may be used.

Whenever the rate of penetration of jet drill 20 is less than desired or becomes very slow, drilling fluid containing abrasive particles may be used. Once drainhole 16 has reached its predetermined length, pumping is reduced and coiled tubing 24 and elastomeric tubing 22 are reeled in. Upset tubing 26, if it is present, can then be turned and the whole process can be repeated to drill another lateral in another azimuth direction. This of course can be repeated many times at each level and in many reservoirs intersecting well 10.

Although apparatus described above can be used with the bit nozzles disclosed herein to form drainholes or other types of holes in the earth, it should be understood that other apparatus may be used to place and operate the nozzles disclosed herein.

Figure 2:
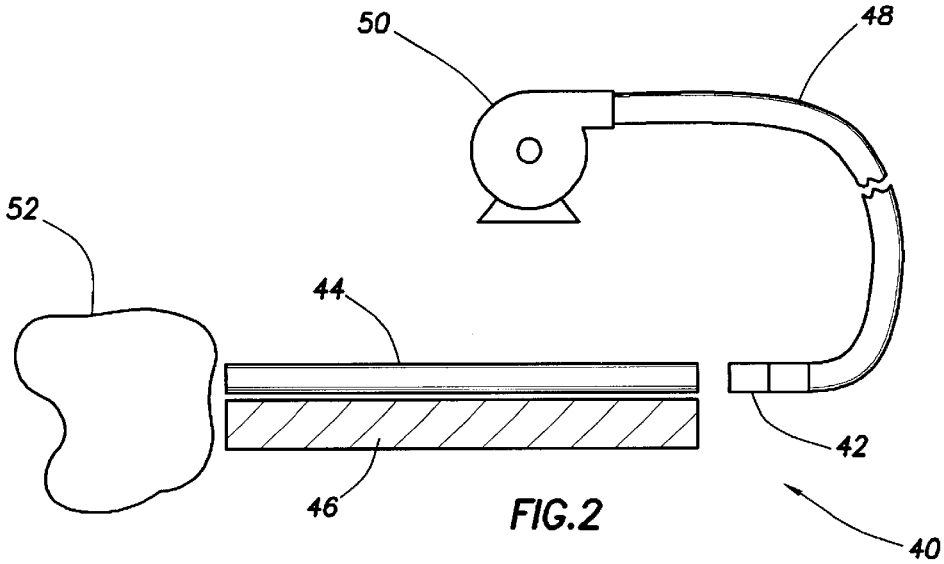
FIG. 2 illustrates an experimental set-up that can be used to test jet bits.

Referring to FIG. 2, test apparatus 40 for testing jet nozzles is shown. Nozzle 42 to be tested is attached to flexible hose 48, which can be placed through pipe 44, which is mounted on support 46. High-pressure pump 50 supplies test fluid, which is normally water or water containing a water-soluble polymer or abrasive particles. Sample 52 is a sample of rock to be drilled, which is typically sandstone or limestone. Pump 50 is preferably capable of supplying pressures up to 10,000 psi and flow rates up to 12 GPM. Nozzle 42 is placed at a selected stand-off distance from sample 52 when drilling is initiated. Force applied to hose 48 as drilling progresses is observed. In some instances a force is applied to increase standoff distance of nozzle 42 from the bottom of the hole. In other instances a nozzle will move through a rock sample with no force applied. The drilling rate and size of the drilled hole are observed.

Figure 3C:
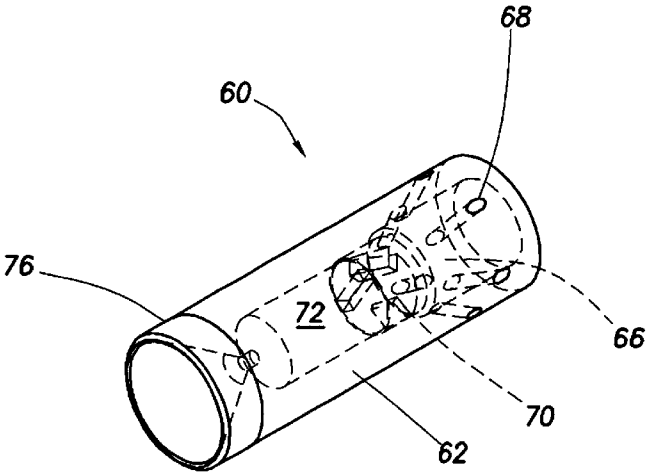
FIG. 3 illustrates one embodiment of a jet bit having a stand-off section.
Figure 3A:
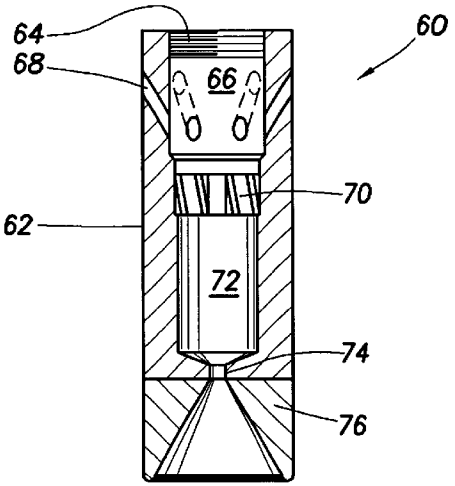
Figure 3B:
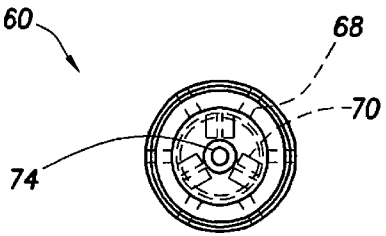

Referring to FIG. 3, one embodiment of nozzle 60 disclosed herein is shown. In FIG. 3(*a*), body 62 may be formed from a high-strength steel such as stainless A suitable material is 416 stainless steel that is hardened. One process for hardening that is suitable is to preheat the nozzle to 1500 ° F. then to 1800 ° F. The nozzle is then quenched in oil and tempered at between 650 and 700 ° F. A suitable hardness is between 35 and 40 (Rockwell C scale). The hardening greatly reduces damage to the nozzle by erosion. Other hardening techniques and hard materials may be used for body 62 of nozzle 60.

Threaded area 64 may be used as a connector mechanism for attaching the nozzle to a hose or conduit. Back chamber 66 may have rear-facing orifices 68 that serve primarily to propel the nozzle through the earth as a hole is being drilled. These orifices may also serve to enlarge the hole. The diameter of these orifices may be in the range from about 0.020 inch to about 0.060 inch. Size may be adjusted to account for different numbers of orifices used, type of rock to be drilled, and the needed thrust on the bit to insure that a force is provided to move the bit and the attached tube through the hole to be drilled. The radial angle of the orifices, which is the acute angle between the orifices and the longitudinal axis of the bit, is preferably in the range from about 20 degrees to about 70 degrees. Alternatively, these orifices may not be present.

Disc 70, which may be used to create a swirling motion to fluid passing through the nozzle, will be described in detail below. Alternatively, the swirling motion of the fluid may be created by vanes or other devices known to impart swirling motion to fluid passing through, as known in the art. Chamber 72 contains a volume of swirling fluid created by disk 70 or other device to create swirling flow before the fluid passes through front orifice 74. Front orifice 74 may have a diameter in the range from about 0.020 to about 0.100 inch. A suitable diameter is about 0.060 inch. In prior art nozzles, the fluid jet exiting front orifice 74 forms a free jet that then grows in diameter and impinges, after a selected stand-off distance, on the bottom of the hole that is being formed. In the nozzle disclosed herein, extension 76 is joined to body 62 at front orifice 74. The swirling jet is thus confined beyond front orifice 74. The interior surface of extension 76 may be conical in shape, as shown in FIG. 3, or may be cylindrical. Multiple cylinders having increasing diameter as the front end of extension 76 is approached may be used. The length of extension 76 along the flow axis is preferably in the range from about 0.2 to about 1.1 inch for a nozzle having a front orifice of 0.060 inch. Greater or less lengths may be used. The length of body 62 may be in the range from about 0.6 to about 1.0 inch, but in some applications longer nozzles may be used to increase the tendency of the nozzle to drill a straight hole. Maximum combined length of the nozzle and extension will be limited by the ability to divert the nozzle if it is to be diverted such as in a wellbore.

FIG. 3(*b*) shows an end view of nozzle 60. The outside diameter of body 62 of nozzle 60 and extension 76 is typically in the range from about 0.300 inch to 1.0 inch, but larger or smaller diameters may be used.

FIG. 3(*c*) shows an isometric view of nozzle 60. It is clear that details of dimensions may vary widely and the nozzle still achieve the objectives of imparting swirling motion to a portion of the throughput fluid with disk 70 or other device to impart swirling motion, producing a swirling jet through front orifice 74 and confining that jet so as to produce improved drilling rate with extension 76.

Figure 4C:
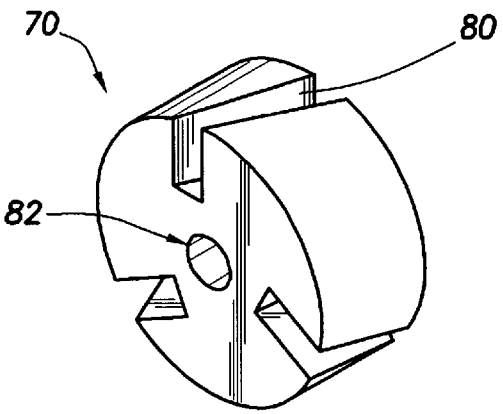
FIG. 4 illustrates one embodiment of a disk that can be used for imparting swirling motion inside a jet bit.
Figure 4A:
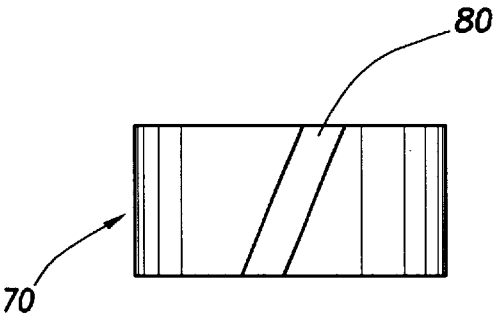
Figure 4B:
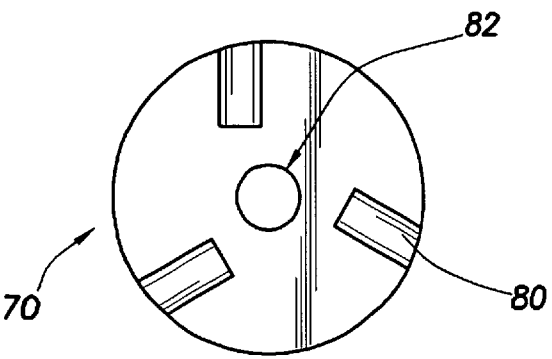

FIG. 4 shows drawings of disk 70 in more detail. In FIG. 4(*a*), one of orifices or slots 80 at the perimeter of disk 70 is shown. Such orifice is formed at a selected tangential angle, which is the acute angle between the orifice and the direction of the axis through the disk. This selected angle will commonly be in the range from about 30 degrees to about 60 degrees, and will preferably be in the range around 45 degrees. The width and depth of the slot may be in the range from about 0.015 to about 0.035 inch, but may be more or less to achieve an optimum swirl velocity of fluid exiting nozzle 60. Center orifice 82 of disk 70 is selected to achieve an axial velocity to maximize drilling rate under conditions specified. The diameter of center orifice 82 may be about 0.045 inch (this dimension produced satisfactory results when the three slots 80 were 0.028 inch wide and deep) or in the range from about 0.030 inch to about 0.100 inch.

FIG. 4(*b*) shows an end view of disk 70, with central orifice 82 and three equally spaced slots 80. More or less slots may be used, but preferably at least two slots or orifices are present in disk 70. FIG. 4(*c*) shows an isometric view of disk 70.

EXAMPLE 1

A sandstone sample was drilled with test equipment 40 shown in FIG. 2, using a swirling jet nozzle such as shown in FIG. 3 but without extension 76. After the nozzle entered the rock, it was necessary to apply force to hose 48 to move the nozzle away from the rock face to achieve an optimum drilling rate. Once stand-off distance was created, the nozzle could be allowed to advance, but it was necessary to control movement of the nozzle to maintain a stand-off distance. When the stand-off distance was controlled, a drilling rate of 3.5 feet per minute was observed at a pressure of about 6,000 psi and a flow rate of 10 GPM. After extension 76 was added (FIG. 3(*a*)), a hole could be cut with no external force applied to hose 48.

EXAMPLE 2

A "431" sandstone sample was placed in position in test equipment 40 shown in FIG. 2. With extension 76 in place, as shown in FIG. 3, after about 10 seconds of flow to get "set" of the nozzle, a hole 13 inches deep was cut in 10 seconds at a pressure of 6,000 psi. The nozzle moved without application of force to hose 48. This is an important advantage, because a hose and nozzle can be placed in a hole and caused to drill freely by pumping the drilling fluid, moving the hose and nozzle from the force applied by the nozzle. Without the extension, the nozzle would not effectively drill a hole under the same conditions.

EXAMPLE 3

A nozzle like that shown in FIG. 3 but without extension 76 was used to drill sandstone at 7200 to 7800 psi. It was necessary to apply force to hose 48 to restrain the nozzle. A 6.5-inch deep hole was drilled in about 1 minute.

EXAMPLE 4

A nozzle like that shown in FIG. 3 but without extension 76 was used to drill sandstone. At 4000 psi with a 2-inch stand-off, pumping for 15 seconds produced a hole 1.5 inches in diameter and 0.25 inch deep. At 6,000 psi for the same conditions, the hole was only slightly deeper. At 1-inch stand-off and 6,000 psi for 30 seconds, the hole diameter was 2.25 inch and the depth was only 0.25 inch. With the nozzle in contact with the rock, at 6,000 psi for 10 seconds, a hole ⅞ inch in diameter and 0.5 inch depth was produced. Flow rates were in the range of 7 GPM. Thus, the nozzle of FIG. 3 without extension 76 would not penetrate the sandstone at above a rate of about 3 inches/minute or 15 feet/hour.

EXAMPLE 5

Using a nozzle such as in FIG. 3 with rear orifices 68 at a radial angle of 30 degrees and with six rear orifices, each having a diameter of 0.029 inch, with disk 70 having a central orifice diameter of 0.045 inch and three peripheral orifices equilaterally spaced around the circumference of the disk with the width and depth of each slot being 0.028 inch and making a 45 degree tangential angle, and the front orifice having a diameter of 0.060 inch, with the length of extension 76 being 0.375 inch beyond the front of orifice 74, at a pump pressure of about 7,000 psi and a flow rate of 10 GPM, the nozzle cut relatively hard sandstone at the rate of 7 feet/minute.

While the preferred embodiments of the invention have been disclosed herein, further modifications to the preferred embodiments will occur to those skilled in the art and such obvious modifications are intended to be within the scope and spirit of the present invention.

What we claim is:

1. A nozzle for jet drilling, comprising:

a body having an inlet end and an outlet end, the inlet end having a connector mechanism thereon, the body having a longitudinal axis and forming an inlet chamber adjacent the inlet end;

a disk for imparting swirling motion to the fluid inside the body, the disk disposed between the inlet chamber and a second chamber, the second chamber having an outlet, the disk having a plurality of orifices therethrough, at least one of the orifices being directed at a selected tangential angle with respect to the longitudinal axis for imparting a swirling motion to fluid in the second chamber;

a front orifice forming the outlet of the second chamber, the front orifice having a selected diameter; and an extension affixed to the outlet end of the body, the extension having an interior surface for confining fluid in a radial direction, the interior surface having a diameter greater than the diameter of the front orifice.

2. The nozzle of claim 1 further comprising orifices in the inlet chamber, the orifices extending from the inlet chamber through the body, the orifices being directed toward the inlet end of the body at a selected radial angle with respect to the longitudinal axis.

3. The nozzle of claim 2 wherein the orifices from the inlet chamber through the body have a diameter in the range from about 0.02 inch to about 0.06 inch.

4. The nozzle of claim 2 wherein the selected radial angle of the orifices of the inlet chamber is in the range from about 20 degrees to about 70 degrees with respect to the longitudinal axis.

5. The nozzle of claim 1 wherein the connector mechanism is threads.

6. The nozzle of claim 1 wherein the body has an outside diameter in the range from about 0.3 inch to about 1 inch.

7. The nozzle of claim 1 wherein the selected tangential angle of the disk orifices through the disk is in the range from about 30 degrees to about 60 degrees with respect to the direction of the longitudinal axis.

8. The nozzle of claim 1 wherein the selected diameter of the front orifice is in the range from about 0.02 inch to about 0.10 inch.

9. The nozzle of claim 1 wherein the extension affixed to the body has a length in the range from about 0.2 inch to about 1.1 inch.

10. The nozzle of claim 1 wherein the extension has an outside diameter in the range from about 0.3 inch to about 1 inch.

11. The nozzle of claim 1 wherein the interior surface of the extension has a conical shape.

12. The nozzle of claim 1 wherein the interior surface of the extension has a cylindrical shape.

13. The disk of claim 1 wherein one of the orifices is a center orifice.

14. The disk of claim 13 wherein the diameter of the center orifice is in the range from about 0.030 inch to about 0.100 inch.

15. A method for drilling holes at a selected location in the earth, comprising:

providing a pump and a drilling fluid;

attaching a nozzle to a length of tubing and placing the nozzle in contact with the earth at the selected location, the nozzle being the nozzle of claim 1 or the nozzle of claim 2; and pumping the drilling fluid through the length of tubing and the nozzle so as to drill through the earth.

16. The method of claim 15 wherein the selected location in the earth is around a well penetrating a subsurface formation and the length of tubing is a length of flexible tubing, further comprising the step of placing a bit diverter in the well at a selected location opposite the subsurface formation and placing the length of flexible tubing and the nozzle in the well before pumping the drilling fluid.

17. The method of claim 16 further comprising the step of placing geophones around the well and detecting acoustic waves to determine the location of the bit.

18. The method of claim 16 further comprising the step of placing a direction-indicating instrument in the well to determine the direction of the bit before or during drilling.

19. The method of claim 16 further comprising the step of adding abrasive particles to the drilling fluid.

20. A method for drilling through the earth, comprising:

providing a nozzle, the nozzle having a body, the body having an inflow end and an outflow end, the inflow end being attached to a tube for pumping a fluid therethrough, a device within the body for imparting a swirling motion to the fluid passing through the body before the fluid is discharged through a front orifice of the body, the front orifice having a diameter, and an extension attached to the outflow end of the body at the front orifice for confining the fluid in a radial direction, the extension having an internal surface, the internal surface having a diameter greater than the diameter of the front orifice; and placing the nozzle in a selected location where a hole is to be drilled and pumping the fluid through the nozzle and the tube.

21. The method of claim 20 wherein the nozzle further comprises orifices through the body, the orifices being directed toward the inflow end of the body for applying a force to the body during pumping of the fluid.

22. The method of claim 20 wherein the front orifice of the body has a diameter in the range from about 0.030 inch to about 0.10 inch.

23. The method of claim 20 wherein the selected location is adjacent to the wellbore of a well.

* * * * *